US009810108B2

(12) United States Patent
Pritchard et al.

(10) Patent No.: US 9,810,108 B2
(45) Date of Patent: Nov. 7, 2017

(54) ENGINE VARIABLE CAMSHAFT TIMING PHASER WITH PLANETARY GEAR ASSEMBLY

(71) Applicant: BorgWarner Inc., Auburn Hills, MI (US)

(72) Inventors: Larry A. Pritchard, Macomb, MI (US); Thomas R. Benner, Lansing, NY (US); Christopher J. Pluta, Lansing, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/507,526

(22) PCT Filed: Aug. 24, 2015

(86) PCT No.: PCT/US2015/046470

§ 371 (c)(1),
(2) Date: Feb. 28, 2017

(87) PCT Pub. No.: WO2016/036529

PCT Pub. Date: Mar. 10, 2016

(65) Prior Publication Data

US 2017/0248045 A1 Aug. 31, 2017

Related U.S. Application Data

(60) Provisional application No. 62/045,731, filed on Sep. 4, 2014.

(51) Int. Cl.
*F01L 1/344* (2006.01)
*F01L 1/348* (2006.01)
(Continued)

(52) U.S. Cl.
CPC ..... *F01L 1/348* (2013.01); *F01L 1/047* (2013.01); *F01L 1/34413* (2013.01); *F01L 1/08* (2013.01);
(Continued)

(58) Field of Classification Search
CPC F01L 1/344; F01L 2013/103; F01L 2820/032
(Continued)

(56) References Cited

U.S. PATENT DOCUMENTS 5,117,784 A * 6/1992 Schechter ..... F01L 1/352 123/90.17
5,680,836 A * 10/1997 Pierik ..... F01L 1/352 123/90.17
(Continued)

FOREIGN PATENT DOCUMENTS

JP H0693812 A 4/1994

OTHER PUBLICATIONS

International Search Report for PCT/US2015/046470 dated Oct. 29, 2015.

*Primary Examiner* — Jorge Leon, Jr.
(74) *Attorney, Agent, or Firm* — Thomas F. Quinn, Jr.

(57) ABSTRACT

An engine variable camshaft timing phaser (10) includes a sprocket (12) and a planetary gear assembly (14). The sprocket (12) receives rotational drive input from an engine crankshaft. The planetary gear assembly (14) includes two or more ring gears (26, 28), multiple planet gears (24), a sun gear (22), and a wrap spring (76). One of the ring gears (26, 28) receives rotational drive input from the sprocket (12) and one of the ring gears (26, 28) transmits rotational drive output to an engine camshaft. The sun gear (22) engages with the planet gears (24). The wrap spring (76) experiences expansion and contraction exertions to permit advancing and
(Continued)

retarding engine valve opening and closing, and to prevent advancing and retarding engine valve opening and closing.

15 Claims, 4 Drawing Sheets

(51) Int. Cl.

| | |
|---|---|
| ***F01L 1/047*** | (2006.01) |
| *F01L 1/34* | (2006.01) |
| *F01L 1/08* | (2006.01) |
| *F01L 1/352* | (2006.01) |

(52) U.S. Cl.
CPC ..... *F01L 1/34* (2013.01); *F01L 1/3442* (2013.01); *F01L 1/34403* (2013.01); *F01L 1/34409* (2013.01); *F01L 1/352* (2013.01); *F01L 2001/34459* (2013.01); *F01L 2250/04* (2013.01); *F01L 2820/01* (2013.01); *F01L 2820/032* (2013.01)

(58) Field of Classification Search
USPC ..... 123/90.17, 90.31
See application file for complete search history.

(56) References Cited

U.S. PATENT DOCUMENTS

| | | | | |
|---|---|---|---|---|
| 6,039,016 | A | 3/2000 | Noguchi | |
| 2001/0003974 | A1 | 6/2001 | Mizutani et al. | |
| 2003/0070641 | A1 | 4/2003 | Watanabe et al. | |
| 2006/0236965 | A1 | 10/2006 | Schaefer et al. | |
| 2007/0169731 | A1* | 7/2007 | Farah ..... | F01L 1/352 123/90.17 |
| 2015/0315939 | A1* | 11/2015 | Showalter ..... | F01L 1/352 123/90.17 |

* cited by examiner

ENGINE VARIABLE CAMSHAFT TIMING PHASER WITH PLANETARY GEAR ASSEMBLY

This application claims the benefit of U.S. Provisional Ser. No. 62/045,731 filed on Sep. 4, 2014, the entire contents of which are hereby incorporated by reference.

TECHNICAL FIELD

The present disclosure generally relates to variable valve timing (VVT) for internal combustion engines, and more particularly relates to variable camshaft timing (VCT) phasers.

BACKGROUND

Variable valve timing (VVT) systems are commonly used with internal combustion engines—such as those found in automobiles—for controlling intake and exhaust valve opening and closing. The VVT systems can help improve fuel economy, reduce exhaust emissions, and enhance engine performance. One type of VVT system employs a variable camshaft timing (VCT) phaser. In general, VCT phasers dynamically adjust the rotation of engine camshafts relative to engine crankshafts in order to advance or retard the opening and closing movements of intake and exhaust valves.

SUMMARY

In one embodiment, an engine variable camshaft timing phaser includes a sprocket and a planetary gear assembly. The sprocket receives rotational drive input from an engine crankshaft. The planetary gear assembly includes two or more ring gears, multiple planet gears, a sun gear, and a wrap spring. One ring gear receives rotational drive input from the sprocket, and one ring gear transmits rotational drive output to an engine camshaft. Each of the planet gears is engaged with the ring gears. The sun gear is engaged with each of the planet gears. The wrap spring has a pair of ends and is interrelated with the sun gear in a way to cause abutment with one of the ends and expansion or contraction exertions of the wrap spring. When the planetary gear assembly is driven by an electric motor, abutment with one of the ends permits relative rotation between the sprocket and the engine camshaft for advancing or retarding engine valve opening and closing. And when the planetary gear assembly is back-driven by the engine camshaft, abutment with one of the ends prevents relative rotation between the sprocket and the engine camshaft to preclude advancing or retarding engine valve opening and closing.

In another embodiment, an engine variable camshaft timing phaser includes a sprocket, two or more ring gears, multiple planet gears, a sun gear, a sleeve, and a wrap spring. The sprocket receives rotational drive input from an engine crankshaft. One ring gear receives rotational drive input from the sprocket, and one ring gear transmits rotational drive output to an engine camshaft. Each of the planet gears is engaged with the ring gears. The sun gear is engaged with each of the planet gears. The sleeve is driven by an electric motor. The wrap spring is located partly or more around the sun gear and partly or more around the sleeve. When the sleeve is driven by the electric motor, the wrap spring experiences contraction exertion and relative rotation between the sprocket and the engine camshaft is permitted for advancing or retarding engine valve opening and closing. And when the engine camshaft back-drives the engine variable camshaft timing phaser, the wrap spring experiences expansion exertion and relative rotation between the sprocket and the engine camshaft is prevented to preclude advancing or retarding engine valve opening and closing.

In yet another embodiment, an engine variable camshaft timing phaser includes a sprocket, two or more ring gears, multiple planet gears, a sun gear, a sleeve, and a wrap spring. The sprocket receives rotational drive input from an engine crankshaft. One ring gear receives rotational drive input from the sprocket, and one ring gear transmits rotational drive output to an engine camshaft. Each of the planet gears is engaged with the ring gears. The sun gear is engaged with each of the planet gears and has a first wall and a second wall. The sleeve is driven by an electric motor. The sleeve has a first wall that confronts the first wall of the sun gear. The sleeve has a second wall that confronts the second wall of the sun gear. The wrap spring is located partly or more around the sun gear, and is located partly or more around the sleeve. The wrap spring has a first end situated between the confrontation of the first walls of the sun gear and sleeve, and has a second end situated between the confrontation of the second walls of the sun gear and sleeve. When the sleeve is driven by the electric motor, the sleeve's first wall or the sleeve's second wall comes into abutment with the first end of the wrap spring. This causes contraction exertion of the wrap spring and permits relative rotation between the sprocket and the engine camshaft for advancing or retarding engine valve opening and closing. And when the engine variable camshaft timing phaser experiences back-driving, the sun gear's first wall or the sun gear's second wall comes into abutment with the second end of the wrap spring. This causes expansion exertion of the wrap spring and prevents relative rotation between the sprocket and the engine camshaft to preclude advancing or retarding engine valve opening and closing.

DETAILED DESCRIPTION

Figure 1:
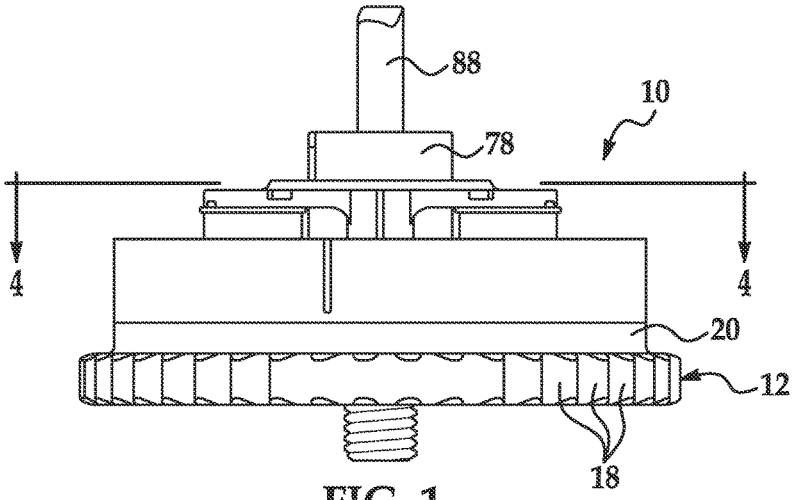
FIG. 1 is a top view of an embodiment of an engine variable camshaft timing phaser.

The figures illustrate embodiments of a variable camshaft timing phaser 10 (hereafter "phaser") that is equipped in an internal combustion engine and that controls intake and exhaust valve opening and closing in the engine. The phaser 10 dynamically adjusts the rotation of the engine's camshaft relative to the engine's crankshaft in order to advance or retard the opening and closing movements of the intake and exhaust valves. Internal combustion engines are perhaps most commonly found in automobiles, but are also found in other applications. While described in greater detail below, in general, a wrap spring of the phaser 10 expands or contracts to bring gears of the phaser to a locked condition where the engine's camshaft is maintained at its angular position relative to the engine's crankshaft. The locked condition precludes a behavior known as "back-driving" in which torque from the intake and exhaust valves compels the phaser's gears to rotate. These rotations are unplanned and unwanted and can ultimately hurt the engine's performance. As an aside, the terms axially, radially, circumferentially, and their related forms are used herein with reference to the generally circular and annular and cylindrical components of the phaser 10, unless otherwise indicated.

The phaser 10 is a multi-piece mechanism with components that work together to transfer rotation from the engine's crankshaft and to the engine's camshaft, and that can work together to angularly displace the camshaft relative to the crankshaft for advancing and retarding engine valve opening and closing. The phaser 10 can have different designs and constructions depending upon, among other possible factors, the application in which the phaser is employed and the crankshaft and camshaft that it works with. In the embodiment presented in FIGS. 1-4, for example, the phaser 10 includes a sprocket 12, a planetary gear assembly 14, and an inner plate or plate 16.

The sprocket 12 receives rotational drive input from the engine's crankshaft and rotates about an axis $X_1$. A timing chain or a timing belt can be looped around the sprocket 12 and around the crankshaft so that rotation of the crankshaft translates into rotation of the sprocket via the chain or belt. Other techniques for transferring rotation between the sprocket 12 and crankshaft are possible. At an exterior, the sprocket 12 has a set of teeth 18 for mating with the timing chain, with the timing belt, or with another component. In different examples, the set of teeth 18 can include thirty-eight individual teeth, forty-two individual teeth, or some other quantity of teeth spanning continuously around the circumference of the sprocket 12. As illustrated, the sprocket 12 has a housing 20 spanning axially from the set of teeth 18. The housing 20 is a cylindrical wall that surrounds parts of the planetary gear assembly 14.

Figure 2:
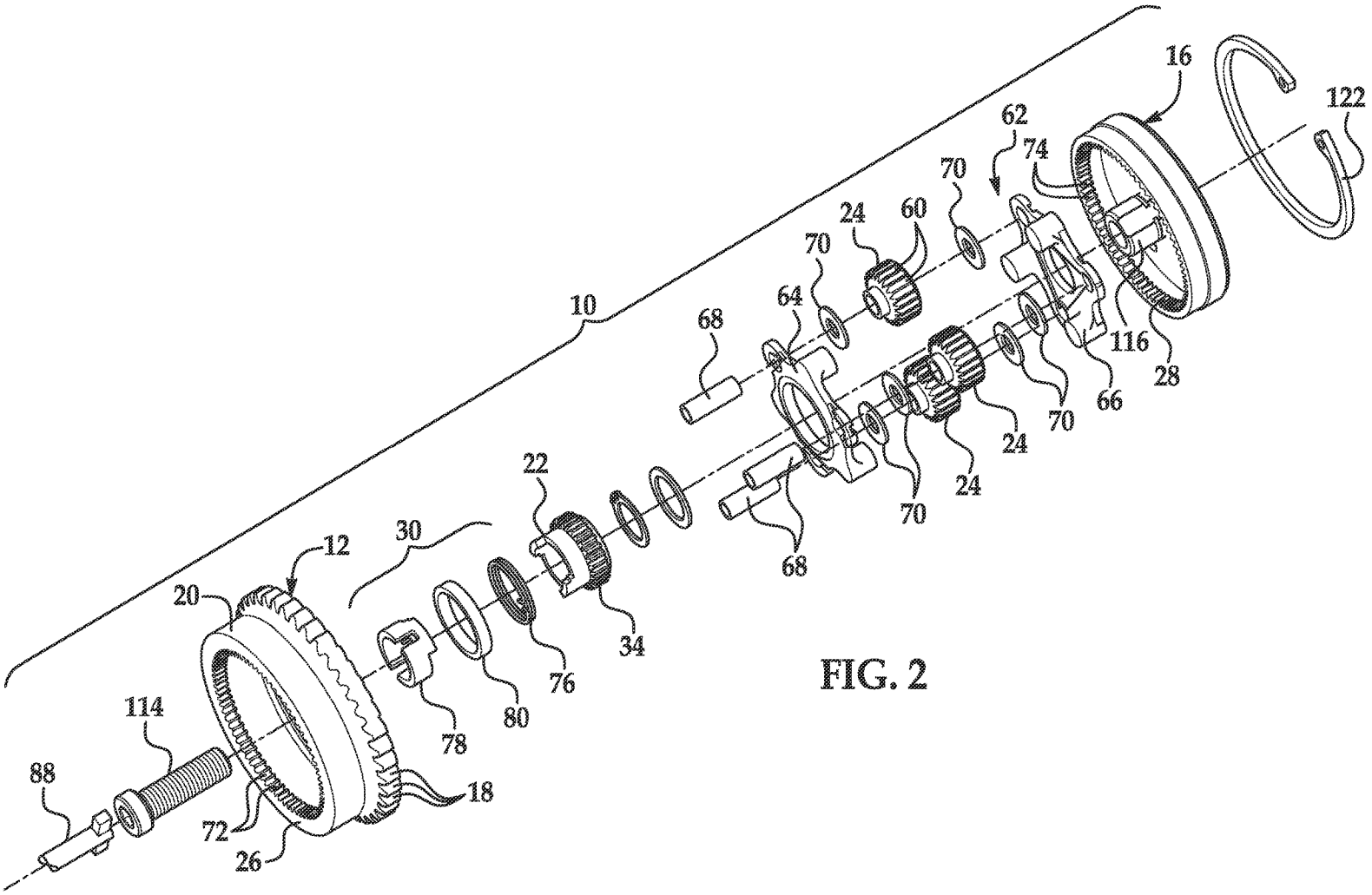
FIG. 2 is an exploded view of the engine variable camshaft timing phaser of FIG. 1.
Figure 4:
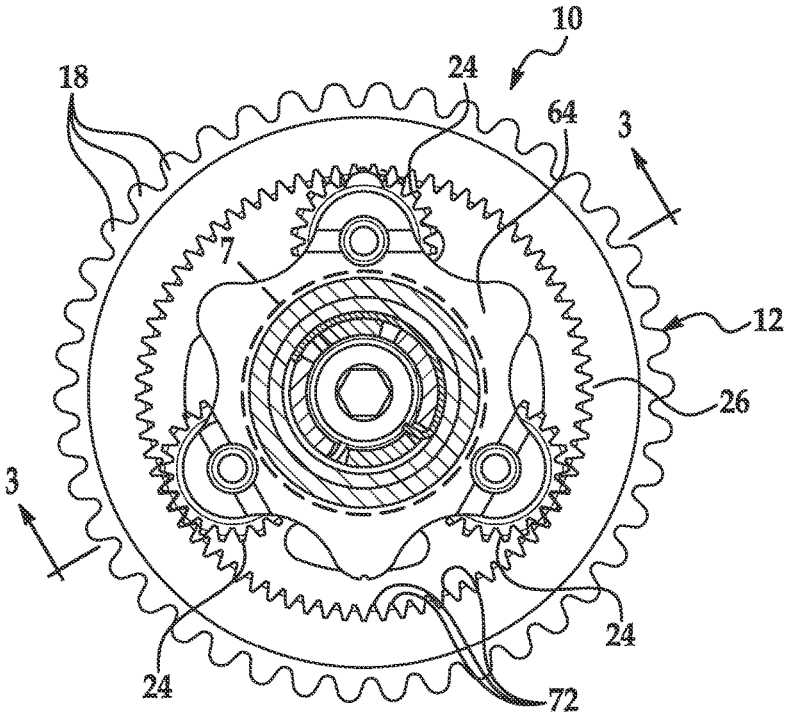
FIG. 4 is a sectional view of the engine variable camshaft timing phaser of FIG. 1, the sectional view taken at arrows 4-4 in FIG. 1.
Figure 5:
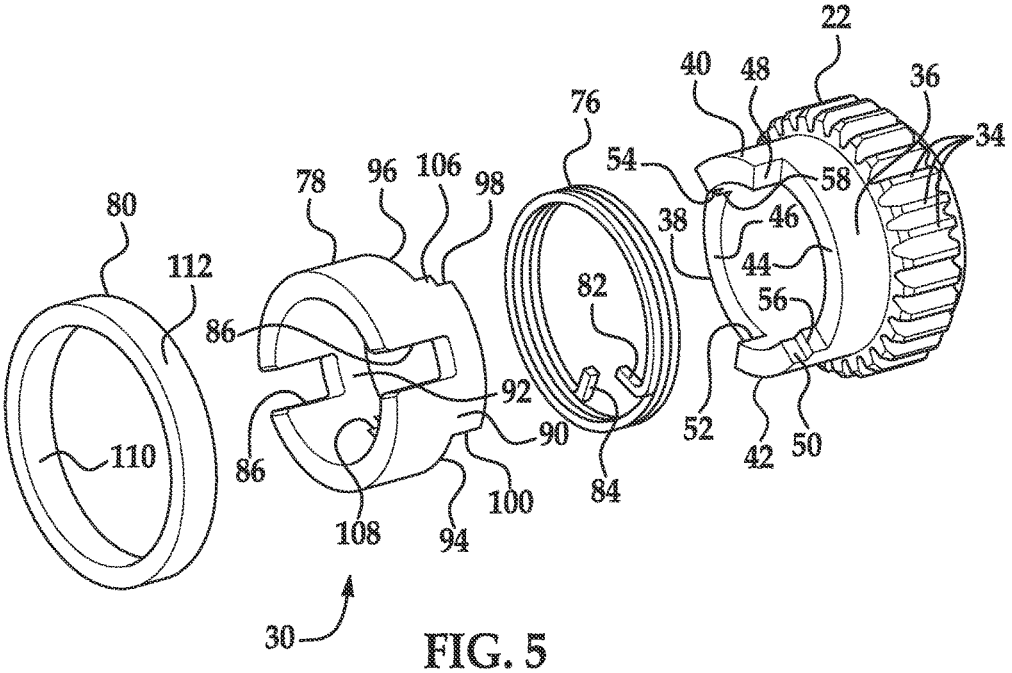
FIG. 5 is an exploded view of an embodiment of a wrap spring assembly that can be used in the engine variable camshaft timing phaser of FIG. 1.

In the embodiment presented here, the planetary gear assembly 14 includes a sun gear 22, planet gears 24, a first ring gear 26, a second ring gear 28, and a wrap spring assembly 30. The sun gear 22 is driven by an electric motor 32 (FIG. 3) for rotation about the axis $X_1$. Referring now to FIGS. 2 and 5, the sun gear 22 engages with the planet gears 24 and has a set of teeth 34 at its exterior that makes direct teeth-to-teeth meshing with the planet gears. In different examples, the set of teeth 34 can include twenty-six individual teeth, thirty-seven individual teeth, or some other quantity of teeth spanning continuously around the circumference of the sun gear 22. A skirt 36 in the shape of a cylinder spans from the set of teeth 34 and to an open end 38 that terminates the extent of the skirt. As described, the sun gear 22 is an external spur gear, but could be another type of gear.

In this embodiment, the skirt 36 has a projection-and-recess contour at its open end 38. A first projection 40 and a second projection 42 are separated from each other around the open end's circumference by a first recess 44 and a second recess 46. A first wall 48, a second wall 50, a third wall 52, and a fourth wall 54 partly define the projections 40, 42 and the recesses 44, 46. As perhaps depicted best in FIG. 5, the second wall 50 has a step 56 formed in it and the fourth wall 54 has a step 58 formed in it.

Figure 3:
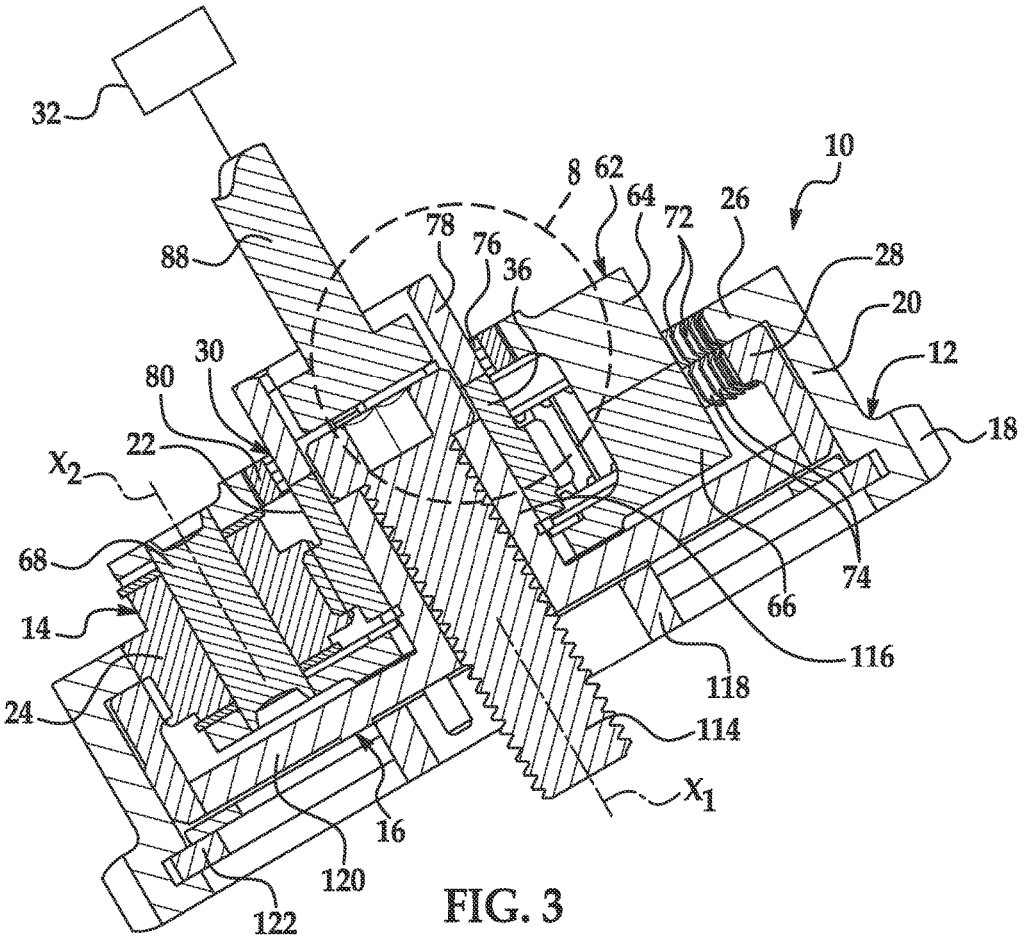
FIG. 3 is a sectional view of the engine variable camshaft timing phaser of FIG. 1, the sectional view taken at arrows 3-3 in FIG. 4.

Referring to FIGS. 2 and 3, the planet gears 24 rotate about their individual rotational axes $X_2$ when in the midst of bringing the engine's camshaft among advanced and retarded angular positions. When not advancing or retarding, the planet gears 24 revolve together around the axis $X_1$ with the sun gear 22 and with the ring gears 26, 28. In the embodiment presented here, there are a total of three discrete planet gears 24 that are similarly designed and constructed with respect to one another, but there could be other quantities of planet gears such as two or four or six. However many there are, each of the planet gears 24 can engage with both of the first and second ring gears 26, 28, and each planet gear can have a set of teeth 60 at its exterior for making direct teeth-to-teeth meshing with the ring gears. In different examples, the teeth 60 can include twenty-one individual teeth, or some other quantity of teeth spanning continuously around the circumference of each of the planet gears 24. To hold the planet gears 24 in place and support them, a carrier assembly 62 can be provided. The carrier assembly 62 can have different designs and constructions. In the embodiment presented in the figures, the carrier assembly 62 includes a top or first carrier plate 64 at one end, a bottom or second carrier plate 66 at the other end, and cylinders 68 that serve as a hub for the rotating planet gears 24. Bolts (not shown) and washers 70 can be used with the carrier assembly 62.

The first ring gear 26 receives rotational drive input from the sprocket 12 so that the first ring gear and sprocket rotate together about the axis $X_1$ in operation. Referring to FIGS. 2 and 3, the first ring gear 26 can be a unitary extension of the sprocket 12—that is, the first ring gear and the sprocket can together make a monolithic structure. In embodiments not illustrated here, the first ring gear 26 and the sprocket 12 could be discrete structures connected together via a cutout-and-tab interconnection, press-fitting, welding, adhering, bolting, riveting, or by another technique. The first ring gear 26 has an annular shape, engages with the planet gears 24, and has a set of teeth 72 at its interior for making direct teeth-to-teeth meshing with the planet gears. In different examples, the teeth 72 can include eighty individual teeth, or some other quantity of teeth spanning continuously around the circumference of the first ring gear 26. In the embodiment presented here, the first ring gear 26 is an internal spur gear, but could be another type of gear.

The second ring gear 28 transmits rotational drive output to the engine's camshaft about the axis $X_1$. Still referring to FIGS. 2 and 3, in this embodiment the second ring gear 28 drives rotation of the camshaft via the plate 16. The second ring gear 28 and plate 16 can be connected together in different ways, including by a cutout-and-tab interconnection, press-fitting, welding, adhering, bolting, riveting, or by another technique. In embodiments not illustrated here, the second ring gear 28 and the plate 16 could be unitary extensions of each other to make a monolithic structure. Like the first ring gear 26, the second ring gear 28 has an annular shape, engages with the planet gears 24, and has a set of teeth 74 at its interior for making direct teeth-to-teeth meshing with the planet gears. In different examples, the teeth 74 can include seventy-seven individual teeth, or some other quantity of teeth spanning continuously around the circumference of the second ring gear 28. With respect to each other, the number of teeth between the first and second ring gears 26, 28 can differ by a multiple of the number of planet gears 24 provided. So for instance, the teeth 72 can include eighty individual teeth, while the teeth 74 can include seventy-seven individual teeth—a difference of three individual teeth for the three planet gears 24 in this example. In another example with six planet gears, the teeth 72 could include seventy individual teeth, while the teeth 74 could include eighty-two individual teeth. Satisfying this relationship furnishes the advancing and retarding capabilities by imparting relative rotational movement and relative rotational speed between the first and second ring gears 26, 28 in operation. In the embodiment presented here, the second ring gear 28 is an internal spur gear, but could be another type of gear.

Together, the two ring gears 26, 28 constitute a split ring gear construction for the planetary gear assembly 14. Still, the planetary gear assembly 14 could include more than two ring gears. For instance, the planetary gear assembly 14 could include an additional third ring gear for a total of three ring gears. Here, the third ring gear could also transmit rotational drive output to the engine's camshaft like the second ring gear 28, and could have the same number of individual teeth as the second ring gear.

Figure 6:
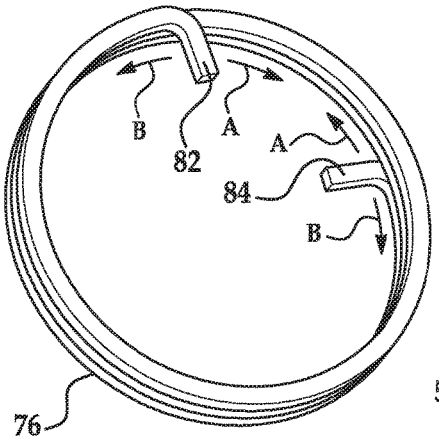
FIG. 6 is a perspective view of an embodiment of a wrap spring that can be used in the wrap spring assembly of FIG. 5.

The wrap spring assembly 30 exerts expansion or contraction forces in use to bring the gears of the planetary gear assembly 14—namely, the sun gear 22, planet gears 24, and ring gears 26, 28—to the locked condition. The wrap spring assembly 30 can have different designs and constructions depending upon, among other possible influences, its placement and location within the planetary gear assembly 14 and the components of the planetary gear assembly that the wrap spring assembly secures together. In the embodiment presented in FIGS. 5-8, for example, the wrap spring assembly 30 includes a wrap spring 76, a sleeve 78, and a lock ring 80. As perhaps illustrated best in FIG. 8, in assembly the wrap spring 76 is located around the outside of both the skirt 36 of the sun gear 22 and the sleeve 78. At the skirt 36, the first and second projections 40, 42 are partly surrounded by the wrap spring 76; and at the sleeve 78, its projections (described below) are partly surrounded by the wrap spring. The wrap spring 76 is coiled in a somewhat truncated cylindrical shape between a first end 82 and a second end 84. In this embodiment, the first and second ends 82, 84 project radially-inwardly with respect to the wrap spring's cylindrical shape. Depending on the forces endured by the ends 82, 84, their structure could be reinforced and strengthened compared to the coiled body of the wrap spring 76. When one of the ends 82, 84 is urged toward the other end as represented by arrows A in FIG. 6, the wrap spring 76 contracts radially-inwardly. And conversely, when one of the ends 82, 84 is urged away from the other end as represented by arrows B in FIG. 6, the wrap spring 76 expands radially-outwardly. The wire used to form the wrap spring 76 in the embodiment here has a square cross-sectional profile and is wound several times without spaces among the turns. Its spring rate may be dictated by the forces emitted to the wrap spring 76 during use of the phaser 10. In specific examples, the wrap spring 76 can exhibit a spring rate that ranges between approximately 0.055 and 0.067 newton meter per radian (Nm/rad, angular spring rate). In other embodiments not illustrated by the figures, the ends 82, 84 could project radially-outwardly, the wire could have a different cross-sectional profile, and the wrap spring 76 could exhibit other spring rates, among the many modifications possible.

Figure 7:
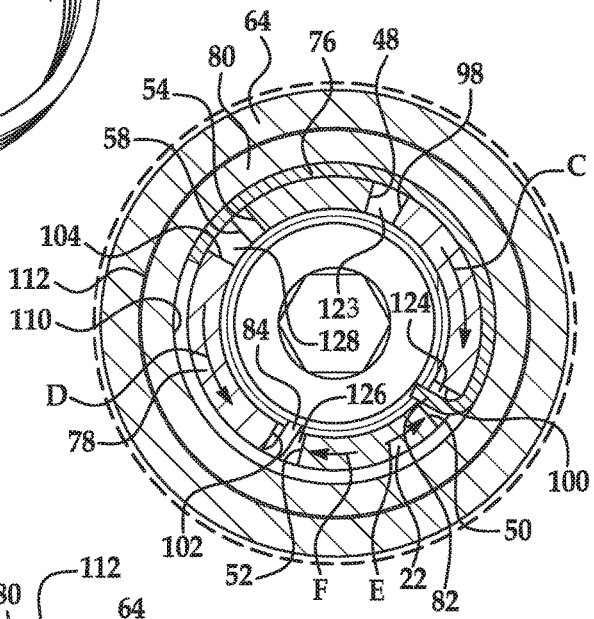
FIG. 7 is an enlarged view taken at the circle denoted by the number seven in FIG. 4.

The sleeve 78 is driven by the electric motor 32 for rotation about the axis $X_1$. Referring now to FIGS. 3 and 5, in this embodiment the sleeve 78 has a cylindrically-shaped body that is open at both ends. A pair of slots 86 is defined in the body at one end for receiving a pin 88 of the electric motor 32. Together, the slots 86 and pin 88 make an interconnection between the sleeve 78 and the electric motor 32. The pin 88 extends from the electric motor 32 and can be part of a drive shaft thereof or can constitute the drive shaft thereof. The pin 88 is presented in the figures in a somewhat generic representation; skilled artisans will appreciate that the pin 88 can take many designs and constructions in application. Opposite the slots 86, and referring particularly to FIG. 5 now, the sleeve 78 has a contour at its open end that generally corresponds to that of the sun gear 22 so that the sleeve and sun gear can interfit and come together in assembly. In the embodiment here, the sleeve 78 has a matching projection-and-recess contour with a first projection 90 and a second projection 92 separated from each other around the open end's circumference by a first recess 94 and a second recess 96. Referring also to FIG. 7, a first wall 98, a second wall 100, a third wall 102, and a fourth wall 104 partly define the projections 90, 92 and the recesses 94, 96. The first wall 98 has a step 106 formed in it and the third wall 102 has a step 108 formed in it.

Figure 8:
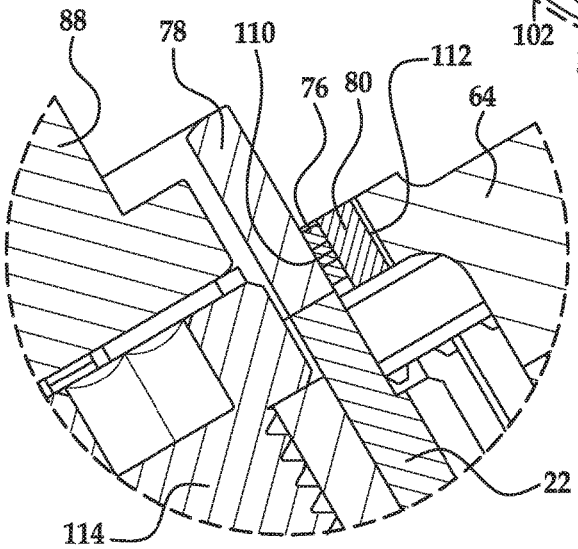
FIG. 8 is an enlarged view taken at the circle denoted by the number eight in FIG. 3.

The lock ring 80 is located around the periphery of the wrap spring 76 and bears the expansion forces exerted against it by the wrap spring without yielding. Referring to FIGS. 5, 7, and 8, the lock ring 80 has an annular shape with an axial extent greater than that of the wrap spring 76. Its inner surface 110 confronts the wrap spring 76, and its outer surface 112 confronts the first carrier plate 64. The lock ring 80 can be fixed to the first carrier plate 64. To increase generated friction during use, the inner or outer surface 110, 112 or both surfaces could be knurled or could have some other type of surface feature. Still, in some embodiments, the lock ring 80 could be omitted and need not be provided, in which case the wrap spring 76 would exert expansion forces against the confronting surface of the first carrier plate 64.

The plate 16 is connected directly to the engine's camshaft and is driven for rotation by its connection with the second ring gear 28. Referring to FIGS. 2 and 3, the connection between the plate 16 and camshaft can be made in different ways, including by way of a bolt 114. In this embodiment, the plate 16 has a first sleeve 116, a second sleeve 118, and a flange 120. The first sleeve 116 is a cylindrical wall that is inserted partially inside of the sun gear 22 and that receives the bolt 114. The first sleeve 116 and sun gear 22 can be slightly spaced apart from each other so they can independently rotate. The second sleeve 118 can serve to pilot connection with the engine's camshaft. And the flange 120 resembles a disk and spans radially outboard to meet the second ring gear 28 for a connection therebetween. Furthermore, a snap ring 122 may be provided in the phaser 10 to help hold components in place.

When put in use, the phaser 10 transfers rotation from the engine crankshaft and to the engine camshaft, and, when commanded by a controller, can angularly displace the camshaft to an advanced angular position and to a retarded angular position. Without camshaft advancing or retarding, the sprocket 12 is driven to rotate about the axis $X_1$ by the engine crankshaft in a first direction (e.g., clockwise or counterclockwise) and at a first rotational speed. Since the first ring gear 26 is unitary or otherwise connected with the sprocket 12, the first ring gear also rotates in the first direction and at the first rotational speed. Concurrently, the electric motor 32 drives the sleeve 78 and the sun gear 22 to rotate about the axis $X_1$ in the first direction and at the first rotational speed. Under these conditions, the sprocket 12, sun gear 22, first and second ring gears 26, 28, and plate 16 all rotate together in unison in the first direction and at the first rotational speed. Also, the planet gears 24 revolve together around the axis $X_1$ in the first direction and at the first rotational speed, and do not rotate about their individual rotational axes $X_2$. Put another way, there is no relative rotational movement or relative rotational speed among the sprocket 12, sun gear 22, planet gears 24, ring gears 26, 28, and plate 16 while not advancing or retarding the camshaft. Due to this lack of relative rotational movement and speed, frictional losses that may otherwise occur between the gears are minimized or altogether eliminated.

In this example, in order to advance the angular position of the engine camshaft, the electric motor 32 drives the sleeve 78 and the sun gear 22 at a second rotational speed in the first direction that is slower than the first rotational speed of the sprocket 12. This creates relative rotational speed and relative rotational movement between the sun gear 22 and the sprocket 12. And because the first and second ring gears 26, 28 have a different number of individual teeth in relation to each other, the first ring gear moves rotationally relative to the second ring gear. At the same time, the planet gears 24 rotate about their individual rotational axes $X_2$. The exact duration of driving the sun gear 22 at the second rotational speed will depend on the desired degree of angular displacement between the engine camshaft and sprocket 12. Once the desired degree is effected, the electric motor 32 will once again be commanded to drive the sleeve 78 and the sun gear 22 at the first rotational speed.

Conversely, in order to retard the angular position of the engine camshaft, the electric motor 32 drives the sleeve 78 and the sun gear 22 at a third rotational speed in the first direction that is faster than the first rotational speed. Relative rotational speeds and movements are once again created between the sun gear 22 and sprocket 12, and the first gear 26 moves rotationally relative to the second gear 28. And as before, the planet gears 24 rotate about their individual rotational axes $X_2$. Still, in another example, to advance the angular position, the second rotational speed could be faster than the first rotational speed; and to retard the angular position, the third rotational speed could be slower than the first rotational speed; this functionality depends on the number of teeth of the ring gears.

When operated in this manner and the sleeve 78 is driven to rotate by the electric motor 32, the wrap spring 76 permits camshaft advancing and retarding, or at least does not preclude advancing and retarding since the sun gear 22 can be driven at a different rotational speed than the sprocket 12. In assembly, the sun gear 22 and sleeve 78 are brought together and the first projection 40 is received in the second recess 96, the second projection 42 is received in the first recess 94, the first projection 90 is received in the first recess 44, and the second projection 92 is received in the second recess 46. Gaps are defined among the confronting walls of the projections 40, 42, 90, 92 and recesses 44, 46, 94, 96. That is, the projections 40, 42, 90, 92 have a smaller circumferential extent than the circumferential extent of the recesses 96, 94, 44, 46 so that a circumferential spacing exists between the sleeve 78 and sun gear 22 at their interfit. This allows a somewhat limited amount of relative circumferential rotation between sleeve 78 and sun gear 22. Referring to FIG. 7, a first gap 123 is defined between the first wall 48 and the first wall 98, a second gap 124 is defined between the second wall 50 and the second wall 100, a third gap 126 is defined between the third wall 52 and the third wall 102, and a fourth gap 128 is defined between the fourth wall 54 and the fourth wall 104. Further, in assembly, the ends 82, 84 of the wrap spring 76 are situated in two of the gaps. In FIG. 7, the first end 82 is situated within the second gap 124 and the second end 84 is situated within the third gap 126; the ends could be situated in other gaps. The steps 56, 58, 106, 108 maintain spacing between the walls 48, 98, 50, 100, 52, 102, 54, 104 and thereby maintain the gaps 123, 124, 126, 128 during use of the phaser 10. In this way, the walls 48, 98, 50, 100, 52, 102, 54, 104 do not completely close-in on the ends 82, 84 during use. Still, in other embodiments the steps 56, 58, 106, 108 need not be provided, in which case the walls 48, 98, 50, 100, 52, 102, 54, 104 would pinch the ends 82, 84 upon rotation of the sleeve 78 and sun gear 22.

When the electric motor 32 drives the sleeve 78 to rotate in the first direction or to rotate in a second direction opposite the first direction, the walls of the sleeve can come into abutment with the first end 82 or with the second end 84 of the wrap spring 76 and can urge the end toward the other end in direction A. The wrap spring 76 may in response exert a contraction force. For instance, and still referring to FIG. 7, when the sleeve 78 is driven to rotate in direction C, the second wall 100 can abut the first end 82 and urge it toward the second wall 50. If urged, the urging ceases once the second wall 100 comes into abutment with the step 56. Initially upon rotation, due to the circumferential spacing between the sleeve 78 and sun gear 22, the sleeve rotates relative to the sun gear while the sun gear does not rotate. The gaps 124, 128 reduce in circumferential extent and the gaps 123, 126 correspondingly increase in circumferential extent at the same time. Once the second wall 100 abuts the step 56 and the fourth wall 104 abuts the step 58 in direction C, the sleeve 78 drives the sun gear 22 to rotate with it. The wrap spring 76, sleeve 78, and sun gear 22 then rotate together without relative rotation between them, while the gaps 123, 124, 126, 128 maintain their circumferential extents. Amid these actions, the second end 84 is not urged in direction C and instead remains situated in the third gap 126 free of abutment from the third wall 52. As a result, the wrap spring 76 exerts a contraction force against and around the underlying sleeve 78 and sun gear 22 and the two rotate together in direction C. The contraction force may also reduce friction between the wrap spring 76 and lock ring 80 to permit rotation of the sleeve 78 and sun gear 22; this need not always be the case, and may only occur when friction exists between the wrap spring and lock ring in the first place. If the first end 82 is not urged and contraction force is not exerted, the sleeve 78 and sun gear 22 may still be capable of rotating together in direction C. Conversely, when the sleeve 78 is driven to rotate in direction D, the third wall 102 can abut the second end 84 and urge it toward the third wall 52. If urged, the urging ceases once the step 108 comes into abutment with the third wall 52. Similar actions take place as described above for direction C, and the first end 82 is not urged in direction D. As before, the wrap spring 76 exerts a contraction force and the sleeve 78 and sun gear 22 rotate together in direction D. If not urged, the sleeve 78 and sun gear 22 may still be capable of rotating together in direction D.

When the planetary gear assembly 14 experiences back-driving, the wrap spring 76 prevents camshaft advancing and retarding by bringing the planetary gear assembly to the locked condition. Back-driving occurs due to torque pulses emitted to the engine's camshaft from the engine's intake and exhaust valves amid their opening and closing movements. It has been observed that in some cases the opening and closing movements compel gears of the planetary gear assembly 14 to rotate relative to each other and consequently advance or retard the phaser 10. Phasing by back-driving is unwanted because its occurrence is typically uncontrolled. When in the locked condition, back-driving does not advance or retard the phaser 10. The sprocket 12, ring gears 26, 28, planet gears 24, carrier plates 64, 66, sun gear 22, and plate 16 all rotate together in unison in the locked condition, and without relative rotational movement and without relative rotational speed among them. Absent relative rotational movement and speed, the phaser 10 is incapable of advancing or retarding. The locked condition is established when relative rotational movement is prevented between any two components of the planetary gear assembly 14.

The sun gear 22 can be caused to rotate from the torque pulses emitted to the engine's camshaft. The engine's camshaft transmits rotation to the plate 16; the second ring gear 28 rotates with the plate; the rotation is then transmitted to the planet gears 24; and the planet gears transmit the rotation to the sun gear 22. When the sun gear 22 rotates in the first direction or in the second direction, the walls of the sun gear come into abutment with the first end 82 or with the second end 84 of the wrap spring 76 and urge the end away from the other end in direction B. The wrap spring 76 in response exerts an expansion force. For instance, and referring again to FIG. 7, when the sun gear 22 is back-driven to rotate in direction E, the second wall 50 abuts the first end 82 and urges it toward the second wall 100. The urging ceases once the step 56 comes into abutment with the second wall 100. Similarly as before, initially upon rotation the sun gear 22 rotates relative to the sleeve 78 while the sleeve does not rotate. The gaps 124, 128 reduce in circumferential extent and the gaps 123, 126 correspondingly increase in circumferential extent at the same time. Amid these actions, the second end 84 is not urged in direction E and instead remains situated in the third gap 126 free of abutment from the third wall 102. The urging to the first end 82 causes the wrap spring 76 to exert an expansion force against the lock ring 80 at its inner surface 110. The expansion force generates friction between the wrap spring 76 and lock ring 80 and thereby rotationally locks the sun gear 22 and the first carrier plate 64 together. Relative rotational movement is prevented between these two components of the planetary gear assembly 14—namely, the sun gear 22 and first carrier plate 64—and the locked condition is established. Conversely, when the sun gear 22 is back-driven to rotate in direction F, the third wall 52 abuts the second end 84 and urges it toward the third wall 102. The urging ceases once the step 108 comes into abutment with the third wall 52. Similar actions take place as described for direction E, and the first end 82 is not urged in direction F. As before, the wrap spring 76 exerts an expansion force and the sun gear 22 and first carrier plate 64 are rotationally locked together.

Still, the phaser 10 can have different designs and constructions than detailed in this description and illustrated in the figures. For instance, bringing the planetary gear assembly 14 to the locked condition could be effected in various ways. Rather than rotationally locking the sun gear 22 and first carrier plate 64 together, the sun gear and plate 16 could be rotationally locked together. For example, the construction could involve a wrap spring with its first and second ends projecting radially-outwardly with respect to the wrap spring's cylindrical shape. The wrap spring could interact with the sun gear and plate such that rotation of the plate in either direction would cause the wrap spring to exert a contraction force. The contraction force would then rotationally lock the sun gear 22 and plate 16 together. Still further, the projection-and-recess interfit could perform its functionality without necessarily having the rectangular contour that is shown and described and could have a different contour.

The foregoing description is considered illustrative only. The terminology that is used is intended to be in the nature of words of description rather than of limitation. Many modifications and variations will readily occur to those skilled in the art in view of the description. Thus, the foregoing description is not intended to limit the invention to the embodiments described above. Accordingly the scope of the invention as defined by the appended claims.

What is claimed is:

1. An engine variable camshaft timing phaser (10), comprising:
- a sprocket (12) receiving rotational drive input from an engine crankshaft;
- a planetary gear assembly (14) comprising:
- at least two ring gears (26, 28), one of said at least two ring gears (26, 28) receiving rotational drive input from said sprocket (12) and one of said at least two ring gears (26, 28) transmitting rotational drive output to an engine camshaft;
  - a plurality of planet gears (24) engaged with said at least two ring gears (26, 28);
  - a sun gear (22) engaged with said plurality of planet gears (24); and
  - a wrap spring (76) having a pair of ends (82, 84), said wrap spring (76) interrelated with said sun gear (22) for causing abutment with one of said pair of ends (82, 84) and expansion or contraction exertions of said wrap spring (76);
- wherein, when said planetary gear assembly (14) is driven by an electric motor (32), abutment with one of said pair of ends (82, 84) permits relative rotation between said sprocket (12) and the engine camshaft for advancing or retarding engine valve opening and closing, and when said planetary gear assembly (14) is back-driven by the engine camshaft, abutment with one of said pair of ends (82, 84) prevents relative rotation between said sprocket (12) and the engine camshaft to preclude advancing or retarding engine valve opening and closing.

2. The engine variable camshaft timing phaser (10) as set forth in claim 1, wherein expansion exertion of said wrap spring (76) prevents relative rotation between said sprocket (12) and the engine camshaft, and contraction exertion of said wrap spring (76) permits relative rotation between said sprocket (12) and the engine camshaft.

3. The engine variable camshaft timing phaser (10) as set forth in claim 1, wherein said planetary gear assembly (14) further comprises a sleeve (78), said sleeve (78) and said sun gear (22) cooperating with each other via a projection-and-recess interfit, when said planetary gear assembly (14) is driven by the electric motor (32) said sleeve (78) is driven by the electric motor (32) and abutment between one of said pair of ends (82, 84) and a wall (98, 100, 102, 104) of said sleeve (78) permits relative rotation between said sprocket (12) and the engine camshaft, when said planetary gear assembly (14) is back-driven by the engine camshaft, abutment between one of said pair of ends (82, 84) and a wall (48, 50, 52, 54) of said sun gear (22) prevents relative rotation between said sprocket (12) and the engine camshaft.

4. The engine variable camshaft timing phaser (10) as set forth in claim 1, wherein said planetary gear assembly (14) further comprises a sleeve (78), said sleeve (78) having a first wall (98, 100, 102, 104) and a second wall (98, 100, 102, 104), said sun gear (22) having a first wall (48, 50, 52, 54) and a second wall (48, 50, 52, 54), said first wall (98, 100, 102, 104) of said sleeve (78) confronting said first wall (48, 50, 52, 54) of said sun gear (22), said second wall (98, 100, 102, 104) of said sleeve (78) confronting said second wall (48, 50, 52, 54) of said sun gear (22), one of said pair of ends (82, 84) situated between the confrontation of said first walls (48, 50, 52, 54, 98, 100, 102, 104), and the other of said pair of ends (82, 84) situated between the confrontation of said second walls (48, 50, 52, 54, 98, 100, 102, 104).

5. The engine variable camshaft timing phaser (10) as set forth in claim 4, wherein, when said planetary gear assembly (14) is driven by the electric motor (32), said sleeve (78) rotates and said first wall (98, 100, 102, 104) of said sleeve (78) or said second wall (98, 100, 102, 104) of said sleeve (78) comes into abutment with one of said pair of ends (82, 84) and causes contraction exertion of said wrap spring (76) and permits relative rotation between said sprocket (12) and the engine camshaft.

6. The engine variable camshaft timing phaser (10) as set forth in claim 4, wherein, when said planetary gear assembly (14) is back-driven by the engine camshaft, said first wall (48, 50, 52, 54) of said sun gear (22) or said second wall (48, 50, 52, 54) of said sun gear (22) comes into abutment with one of said pair of ends (82, 84) and causes expansion exertion of said wrap spring (76) and prevents relative rotation between said sprocket (12) and the engine camshaft to preclude advancing or retarding engine valve opening and closing.

7. The engine variable camshaft timing phaser (10) as set forth in claim 1, further comprising a lock ring (80) located at least partly around a periphery of said wrap spring (76), said lock ring (80) obstructing expansion of said wrap spring (76).

8. An engine variable camshaft timing phaser (10), comprising:

a sprocket (12) receiving rotational drive input from an engine crankshaft;

at least two ring gears (26, 28), one of said at least two ring gears (26, 28) receiving rotational drive input from said sprocket (12) and one of said at least two ring gears (26, 28) transmitting rotational drive output to an engine camshaft;

a plurality of planet gears (24) engaged with said at least two ring gears (26, 28);

a sun gear (22) engaged with said plurality of planet gears (24);

a sleeve (78) driven by an electric motor (32);

a wrap spring (76) located at least partly around said sun gear (22) and at least partly around said sleeve (78);

wherein, when said sleeve (78) is driven by the electric motor (32), said wrap spring (76) experiences contraction exertion and relative rotation between said sprocket (12) and the engine camshaft is permitted for advancing or retarding engine valve opening and closing, and when the engine camshaft back-drives the engine camshaft timing phaser (10), said wrap spring (76) experiences expansion exertion and relative rotation between said sprocket (12) and the engine camshaft is prevented to preclude advancing or retarding engine valve opening and closing.

9. The engine variable camshaft timing phaser (10) as set forth in claim 8, wherein said wrap spring (76) has a pair of ends (82, 84), said wrap spring (76) experiences contraction exertion via abutment between said sleeve (78) and one of said pair of ends (82, 84), and said wrap spring (76) experiences expansion exertion via abutment between said sun gear (22) and one of said pair of ends (82, 84).

10. The engine variable camshaft timing phaser (10) as set forth in claim 8, wherein said sun gear (22) and said sleeve (78) cooperate with each other via a projection-and-recess interfit, said projection-and-recess interfit having a first set of confronting walls (48, 50, 52, 54, 98, 100, 102, 104) between said sun gear (22) and said sleeve (78) and having a second set of confronting walls (48, 50, 52, 54, 98, 100, 102, 104) between said sun gear (22) and said sleeve (78), said wrap spring (76) having a first end (82) situated between said first set of confronting walls (48, 50, 52, 54, 98, 100, 102, 104) and having a second end (84) situated between said second set of confronting walls (48, 50, 52, 54, 98, 100, 102, 104).

11. The engine variable camshaft timing phaser (10) as set forth in claim 10, wherein said first set of confronting walls (48, 50, 52, 54, 98, 100, 102, 104) define a first gap (123, 124, 126, 128) when said first set of confronting walls (48, 50, 52, 54, 98, 100, 102, 104) abut each other for receiving said first end (82) of said wrap spring (76) during use of the engine variable camshaft timing phaser (10), said second set of confronting walls (48, 50, 52, 54, 98, 100, 102, 104) define a second gap (123, 124, 126, 128) when said second set of confronting walls (48, 50, 52, 54, 98, 100, 102, 104) abut each other for receiving said second end (84) of said wrap spring (76) during use of the engine variable camshaft timing phaser (10).

12. The engine variable camshaft timing phaser (10) as set forth in claim 8, wherein, when said sleeve (78) is driven to rotate in a first circumferential direction or a second circumferential direction, said sleeve (78) abuts one of a pair of ends (82, 84) of said wrap spring (76) and causes contraction exertion of said wrap spring (76), and when said sun gear (22) rotates in the first circumferential direction or the second circumferential direction, said sun gear (22) abuts one of said pair of ends (82, 84) of said wrap spring (76) and causes expansion exertion of said wrap spring (76).

13. The engine variable camshaft timing phaser (10) as set forth in claim 8, wherein said sun gear (22) has a first and second projection (40, 42) and a first and second recess (44, 46), said sleeve (78) has a first and second projection (90, 92) and a first and second recess (94, 96), said first and second projections (40, 42) of said sun gear (22) are received in said first and second recesses (94, 96) of said sleeve (78), said first and second projections (90, 92) of said sleeve (78) are received in said first and second recesses (44, 46) of said sun gear (22), said wrap spring (76) is located at least partly around said first and second projections and recesses (40, 42, 90, 92, 44, 46, 94, 96) of said sun gear (22) and sleeve (78).

14. An engine variable camshaft timing phaser (10), comprising:

a sprocket (12) receiving rotational drive input from an engine crankshaft;

at least two ring gears (26, 28), one of said at least two ring gears (26, 28) receiving rotational drive input from said sprocket (12) and one of said at least two ring gears (26, 28) transmitting rotational drive output to an engine camshaft;

a plurality of planet gears (24) engaged with said at least two ring gears (26, 28);

a sun gear (22) engaged with said plurality of planet gears (24), said sun gear (22) having a first wall (48, 50, 52, 54) and a second wall (48, 50, 52, 54);

a sleeve (78) driven by an electric motor (32), said sleeve (78) having a first wall (98, 100, 102, 104) confronting said first wall (48, 50, 52, 54) of said sun gear (22), said sleeve (78) having a second wall (98, 100, 102, 104) confronting said second wall (48, 50, 52, 54) of said sun gear (22); and a wrap spring (76) located at least partly around said sun gear (22) and located at least partly around said sleeve (78), said wrap spring (76) having a first end (82)

situated between the confrontation of said first walls (48, 50, 52, 54, 98, 100, 102, 104) of said sun gear (22) and sleeve (78), said wrap spring (76) having a second end (84) situated between the confrontation of said second walls (48, 50, 52, 54, 98, 100, 102, 104) of said sun gear (22) and sleeve (78);

wherein, when said sleeve (78) is driven by the electric motor (32), said first wall (98, 100, 102, 104) of said sleeve (78) or said second wall (98, 100, 102, 104) of said sleeve (78) comes into abutment with said first end (82) of said wrap spring (76) and causes contraction exertion of said wrap spring (76) and permits relative rotation between said sprocket (12) and the engine camshaft for advancing or retarding engine valve opening and closing, and when the engine camshaft timing phaser (10) experiences back-driving, said first wall (48, 50, 52, 54) of said sun gear (22) or said second wall (48, 50, 52, 54) of said sun gear (22) comes into abutment with said second end (84) of said wrap spring (76) and causes expansion exertion of said wrap spring (76) and prevents relative rotation between said sprocket (12) and the engine camshaft to preclude advancing or retarding engine valve opening and closing.

15. The engine variable camshaft timing phaser (10) as set forth in claim 14, further comprising a plate (16) receiving rotational drive input from the one of said at least two ring gears (26, 28) transmitting rotational drive output to the engine camshaft.

* * * * *